United States Patent [19]

Foster et al.

[11] Patent Number: 4,457,730

[45] Date of Patent: Jul. 3, 1984

[54] VACUUM PACKAGED INFLATABLE FLOTATION DEVICE

[75] Inventors: Gordon T. Foster, La Habra; Joseph A. Muklevicz, Lake Forest, both of Calif.

[73] Assignee: Gulf & Western Manufacturing Company, Southfield, Mich.

[21] Appl. No.: 285,027

[22] Filed: Jul. 20, 1981

[51] Int. Cl.[3] ..... B63C 9/12

[52] U.S. Cl. ..... 441/94; 441/42

[58] Field of Search ..... 114/345, 348, 349, 367; 441/30, 40, 41, 42, 80, 90, 92, 94, 96, 99

[56] References Cited

U.S. PATENT DOCUMENTS 4,280,239 7/1981 Brown ..... 441/42

4,355,987 10/1982 Miller ..... 441/42

FOREIGN PATENT DOCUMENTS 1126242 9/1968 United Kingdom .

*Primary Examiner*—Galen L. Barefoot

*Assistant Examiner*—Jesûs D. Sotelo

[57] ABSTRACT

A vacuum packaged flotation device is provided comprising the combination of an inflatable flotation device, equipment for inflating the flotation device which comprises a valve, a container for holding an inflating medium and the inflating medium, and a sealed vacuum package containing the inflatable flotation device and the equipment for inflating same, which is provided with at least one device for automatically or manually, actuating the inflation of the flotation device; wherein the inflation of the flotation device is triggered by a pull force which acts either automatically or manually on one or more connecting lanyards which are attached at one end to the actuation device, which lanyards extend through the vacuum package in such a manner as to preserve the integrity of the vacuum seal, while at the same time allowing the manual triggering of the actuation device with the exertion of a pull force of no more than about 7–15 Kg from any of a plurality of angles.

9 Claims, 3 Drawing Figures

VACUUM PACKAGED INFLATABLE FLOTATION DEVICE

BACKGROUND OF THE INVENTION

The use of vacuum packaged flotation devices having automatic inflation means contained in a sealed vacuum package or envelope is known in the art. Such sealed vacuum packaged inflatable devices find their primary application in various military uses particularly in aircraft where such devices have been employed with great success for actuation in the automatic mode where a connecting lanyard, or line, is provided which automatically triggers the release of the inflating gas to an inflatable life raft upon seat-man separation after ejection from an aircraft.

With the recent development of more stringent military specifications requiring the incorporation in such vacuum packaged inflatable flotation devices of manual means for triggering the release of the inflating medium there has been created a need to redesign the vacuum packing as well as the triggering means in order to provide the necessary flexibility demanded.

In many situations where one might wish to manually trigger the inflation actuation means in any vacuum packaged inflatable flotation device the pilot, or other crewman who might wish to so manually trigger the actuation means, would find himself in a disadvantageous position to exert more than a given maximum pull force on the triggering means provided.

It has, therefore, been deemed mandatory in certain applications, and desirable in others, to provide a means of actuating a sealed vacuum packaged inflatable flotation device which exhibits the ability to be manually operated by the pilot or crewman who might for example have been wounded in combat and/or find it necessary for example to ditch the aircraft in an open body of water where he would not be able to exert a great deal of force upon the manual triggering device provided.

It is, therefore, an object of the present invention to provide a vacuum packaged flotation device comprising the combination of an inflatable flotation device a means for inflating said device which comprises a valve, a container for holding an inflating medium and said inflating medium, and a sealed vacuum package containing said inflatable flotation device and means for inflating same, which is provided with at least one means for automatically and/or manually actuating the inflation of the device; wherein the said means for activating the inflation of the device is triggered by a pull force which acts automatically and/or manually on one or more connecting lanyards which are attached at one end to the actuation means and which lanyards extend through the vacuum package in such a manner as to preserve the integrity of the sealed vacuum package, while at the same time allowing for the easy manual triggering of the actuation means.

A further object of the present invention is to provide for a novel vacuum packed flotation device wherein the manual and/or automatic triggering means for actuating the release of the inflating medium to the inflatable flotation device is affixed to a vacuum package in such a manner as to allow the triggering action to take place with the exertion of a minimum amount of pull force and throughout a specifically defined cone of actuation.

DETAILED DESCRIPTION

Figure 1:
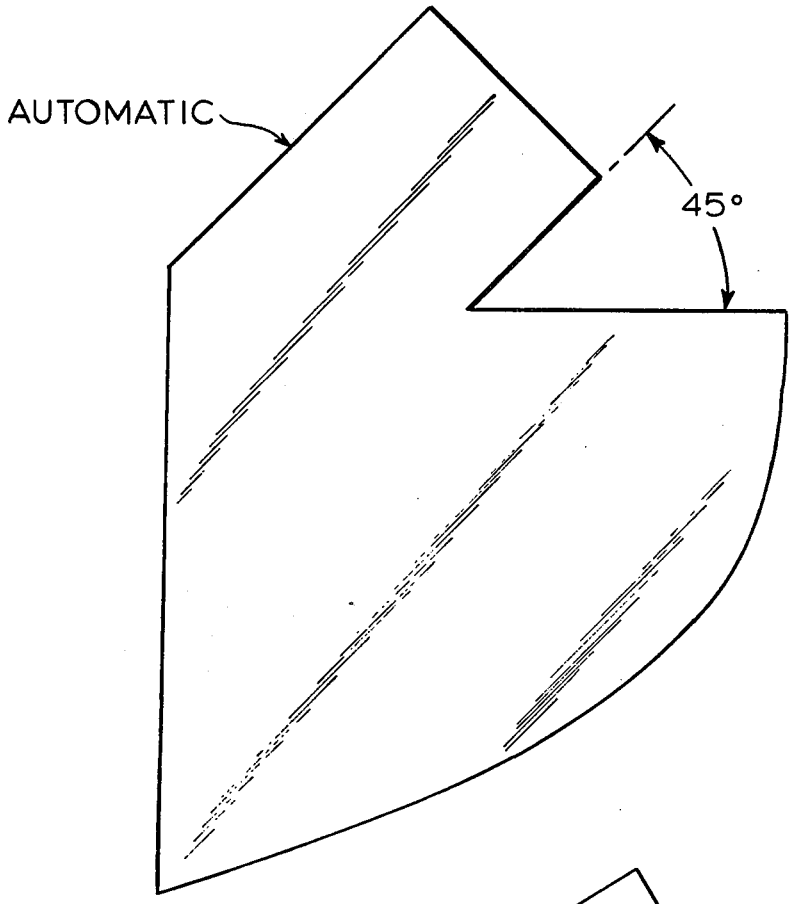
FIG.1 PRIOR ART
FIG. 1 is a schematic representation of a plane view of a section of the outer configuration of the vacuum package of a prior art vacuum packed flotation device showing the configuration of the lanyard extension for the automatic mode as well as the characteristic angle in which such is conventionally deployed.
Figure 2:
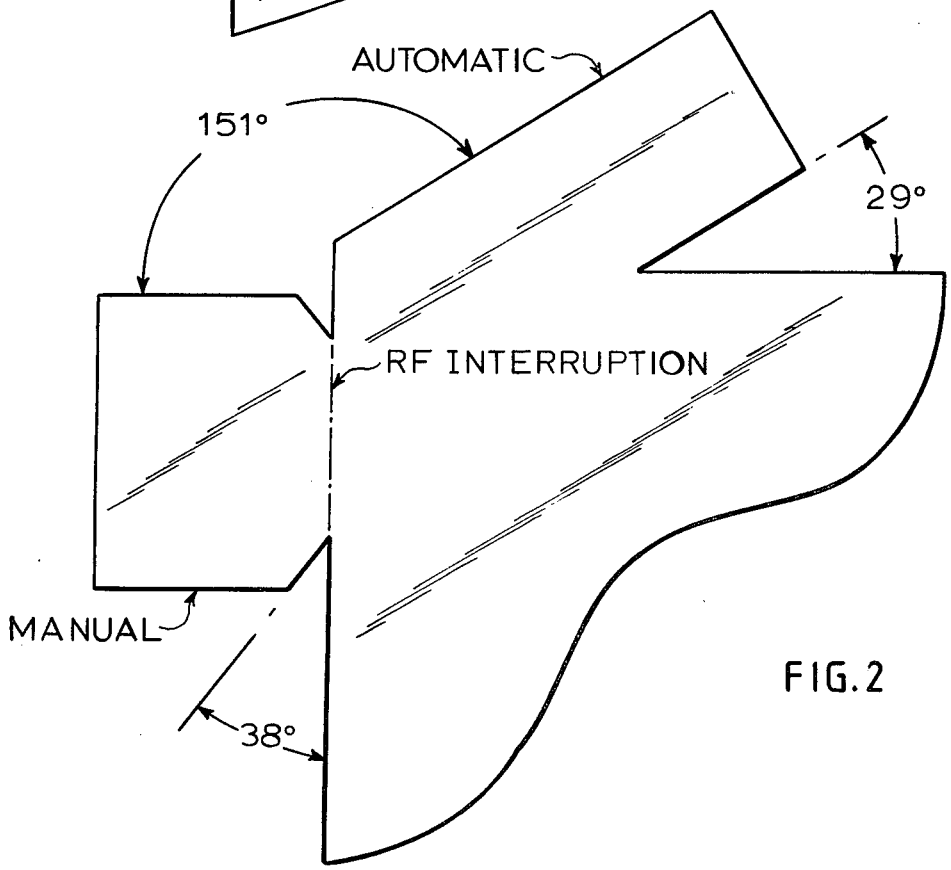
FIG. 2 is a schematic representation of a plane view of a section of the outer configuration of the vacuum package of the present invention showing the extension neck provided in the automatic mode, the "T"-neck provided for the manual mode as well as the preferred angles for use in the packaging arrangement of the present invention.

In one possible embodiment of the present invention the vacuum packaged flotation device provided is a one man life raft which is a single compartment flotation device capable of keeping a man afloat, with all his related survival equipment, until rescued. This life raft incorporates an orally inflatable floor and spray shield affording greater protection to the individual from the elements during foul or cold weather survival environments.

The flotation chamber is inflated either automatically or manually by means of an actuation head. This head is configured so that either of two separate points of actuation can trigger the release of the gas inflation medium into the life raft.

The assembly also includes an inflation valve, a bottle or container for the inflating medium, and when in a charged configuration, one-half pound of $CO_2$ as the inflating medium.

The previously described assembly is packed into the desired configuration affording the most overall versatility for its intended use, while maintaining the least amount of volume. A reduction in volume is obtained by subjecting the packed life raft to a vacuum while in a specially designed envelope. The envelope, or vacuum bag, is fabricated from a unique heat-sealable material.

Construction of the envelope is such that is allows the $CO_2$ bottle containing the inflation medium to be actuated either automatically or manually in concert with envelope rupture. This dual function capability is accomplished by the use of two actuation lanyard assemblies which are attached to the life raft as part of the retention system.

The opposite ends of the lanyards are made in the form of loops which are secured in the actuation necks by means of circle welds. The center of the circle welds are then cut out allowing for attachment to the drop lanyard on the automatic side and a pull handle on the manual side. The circle welds used to seal the cut outs allows this to be accomplished without sacrificing vacuum integrity.

One point of actuation of the actuation head is designated the primary or optimum actuation mode. This primary point is normally secured to the automatic drop lanyard attached to a crewman's survival kit. Upon deployment of the survival kit, while the crewman is suspended under parachute, the life raft falls away to the length of the lanyard and actuation of the $CO_2$ bottle occurs, inflating the life raft. The force required to cause this to occur has been determined to be between 7–15 kg. (16.6–33.0 lb.).

The secondary actuation mode of the head is for manual operation. The manual feature is incorporated so that, for example, in the event a crewman enters the water without being able to automatically deploy the kit, it will still be possible for him to obtain the use of a fully inflated life raft within a short period of time.

The requirements which have been established for operation in the manual mode are the most stringent as they encompass a much larger "cone" of actuation, and, in addition, must provide for the fact that the crewman is now in the water and possibly injured. In other words, the comprised gas container must be actuable from any of a plurality of angles upon the exertion of a relatively small force upon the pull handle. The manual pull force required to trigger the inflation actuation means must remain in the 7–15 kg. range through the entire manual actuation cone, which is much larger than the cone of actuation in the automatic mode.

In addition to the pull force remaining the same, provisions also have to be made to allow for the insertion of the crewman's hand, protected against cold weather, into the loop formed in the manual actuation lanyard. The inclusion of these additional parameters mandate that a specially designed manual actuation neck be provided.

In the present preferred embodiment tear angles of the vacuum bag in the automatic mode have been increased to a cone area encompassing all possible gravity drop requirements while maintaining pull forces in the 7 to 15 kg. range.

The manual aspect of the vacuum packaged inflatable flotation device of the present invention incorporates a novel "T"-shaped configured actuation neck which allows for actuation of the inflation means to be accomplished not only under the most optimum conditions, but also along the longitudinal axis thus providing the necessary desired degree of flexibility not heretofore achieved in designs of the prior art. The design of the "T"-shaped actuation neck incorporates a special welded separation line which also allows for triggering at pull forces in the 7 to 15 kg. range.

The weak point or separation line, is deliberately added to the heat sealable vacuum package at the narrowest point in the "T"-neck configuration prior to evacuation of the internal atmosphere. The addition of this weak point involves the use of a technique referred to as RF transfer interruption.

The manufacture of the vacuum bags which are used as the vacuum packaging material utilizes a special fabric which can be RF "welded" together, on one side only. The weak point of the separation line is formed by installing a piece of leach fabric into the area to be welded, thus causing a pseudo or false weld to occur on the actual vacuum bag. The leach fabric welds to itself but not to the vacuum bag. Upon its removal, the passage from the vacuum bag into the actuation neck remains open allowing for lanyard installation, but the vacuum bag fabric has been noticeably scored. The scoring which is achieved does not compromise vacuum integrity in the end product, however it does supply the required "weak" point in the manual mode to provide 180° longitudinal actuation capabilities, not heretofore obtainable.

Figure 3:
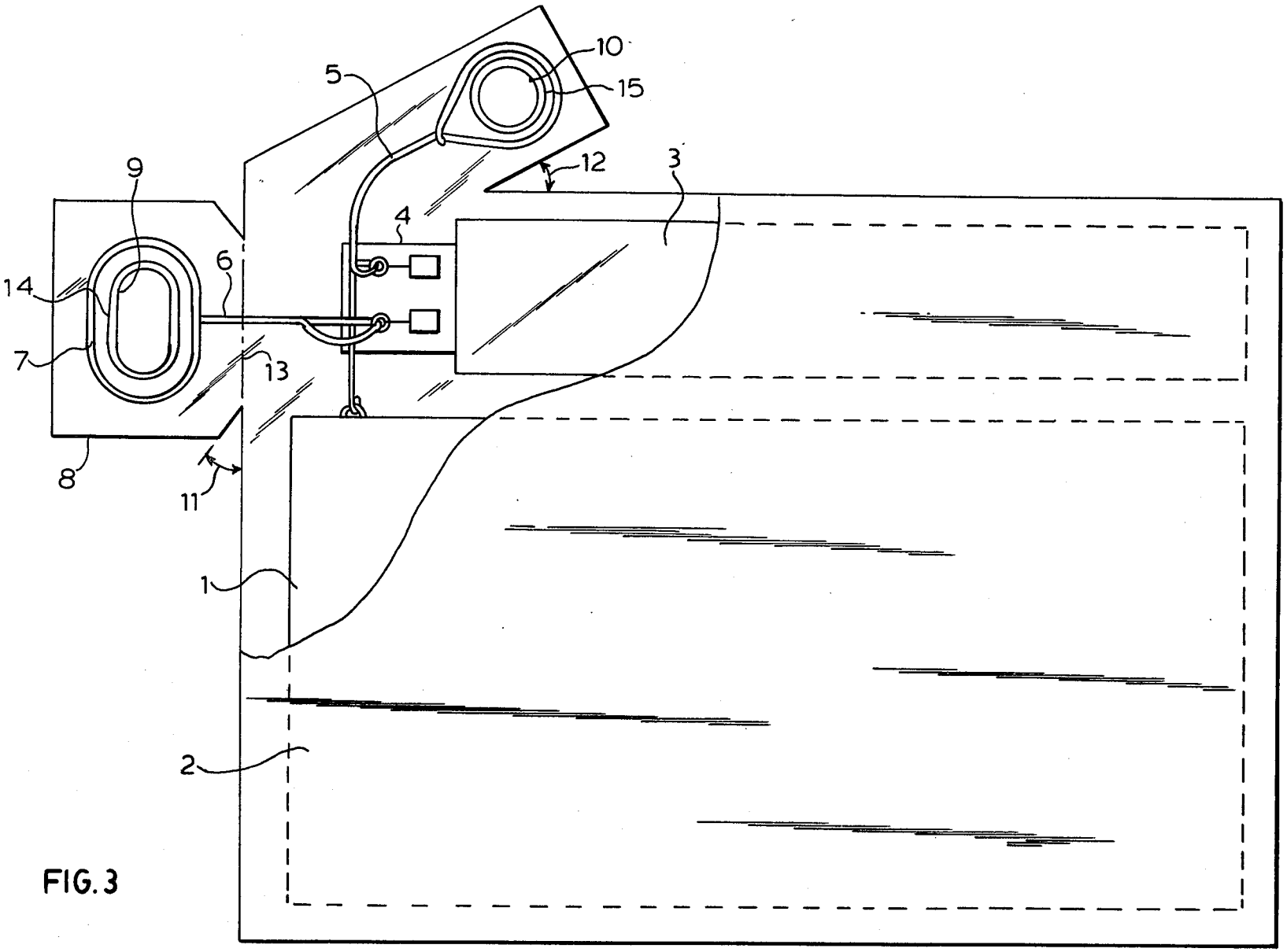
FIG. 3 is a top plane view of one embodiment of the vacuum packaged flotation device of the present invention showing the relationship of the various components.

With reference to FIG. 3, a plane view of one preferred embodiment of the present invention is provided, wherein an inflatable lift raft 1, is enclosed in a vacuum sealed package 2, in juxtaposition with a $CO_2$ container 3, to which is affixed a dual actuated head 4, for either manually or automatically triggering the inflation of the raft. To one of the dual actuation head connectors is affixed an automatic mode actuation lanyard 5. To the other actuation head connector is affixed a manual actuation lanyard 6, which terminates at the manual pull handle 7, in the manual "T" actuation neck 8. A hand hole 9 is provided in the manual "T" actuation neck. Likewise an automatic lanyard connector hole 10 is provided in the automatic actuation neck.

The angle 11 at which the manual "T" actuation neck is connected to the main body of the vacuum package is shown at the preferred 38° for this particular embodiment. Likewise, the angle 12 at which the automatic actuation neck is oriented is shown at the preferred 29° for this particular embodiment. The manual "T" actuation neck is scored at the RF interruption 13. The perimeters of both the manual hand hole 9 and the automatic lanyard connector hole 10, are provided with circle welds 14 and 15, respectively, defining the holes and 10 and preserving vacuum integrity.

While the illustrated embodiment of FIG. 3, depicts the particular angles at which the manual "T" and automatic actuation necks are located with respect to the packaged configuration, it will be appreciated by those skilled in the art that other angles may be employed with good results where alternative embodiments of the package configuration are employed.

That is to say that other configurations, sizes of components and sizes of inflatable devices may dictate variations in the precise location of the actuation neck employed, as well as in the angles 11 and 12, to effect optimum operation under the desired conditions of use. The combination of the use of a "T" shaped actuation neck, a scored weak point in the tapered neck thereof and an angled necking arrangement providing the necessary ability to manually actuate the inflation device with a pull force in the range of about 7–15 kg. that will be common to all embodiments coming within the present scope of the present invention.

Manual "T" actuation neck angles in the order of from about 15° to 45° are contemplated as encompassing angles which will be most effective in achieving the objectives of the present invention. An angle of 38° as depicted in FIG. 3 is the preferred angle for the configuration shown.

Automatic actuation neck angles in the order of from 25° to 40° are contemplated as encompassing those angles which will be most effective in achieving the objects of the present invention. An angle of 29° as depicted in FIG. 3 is the preferred angle for the configuration shown.

A preferred embodiment of the invention has been illustrated and several alternative arrangements have been described which will be effective to achieve the objects set forth. Other alternative construction arrangements, including changes, modifications and substitute of parts, may be made, as will be obvious to those skilled in the art, without departing from the spirit of the invention.

We claim:

1. A vacuum packed inflatable flotation assembly comprising:

an inflatable flotation device;

means for inflating said inflatable flotation device including a container holding an inflating medium;

actuation means for triggering inflation of said inflatable flotation device with said inflating medium;

a sealed, flexible vacuum bag containing said inflatable flotation device, said container, and said actuation means, said bag including a neck portion extending therefrom;

a pull handle positioned within said neck portion, said pull handle including a hand hole extending therethrough;

a weld within said neck portion forming a closed loop within said hand hole;

an opening within said weld and extending through said neck portion; and connecting means connecting said pull handle to said actuation means.

2. A vacuum packaged inflatable flotation assembly according to claim 1 including two lanyards, said actuation means including a dual actuation head affixed to the container holding the inflating medium, one of said lanyards connecting said pull handle with said actuation means, the other of said lanyards connecting said connector loop with said actuation means.

3. An assembly as defined in claim 1 wherein said neck portion forms a pair of acute angles with said vacuum bag.

4. An assembly as defined in claim 1 including a line of weakness formed within said bag and across said neck portion.

5. A vacuum packaged inflatable flotation assembly according to claim 4, wherein said neck portion is a "T" shaped neck and said acute angles extend at about 15° to about 45° with relation to the axis of the line of weakness across said neck portion.

6. A vacuum packaged inflatable flotation assembly according to claim 5 wherein said acute angles are about 38° with relation to the axis of the line of weakness across said neck portion.

7. An assembly as defined in claim 1 wherein said actuation means triggers inflation of said inflatable flotation device in concert with the rupturing of said vacuum bag upon pulling said pull handle.

8. An assembly as defined in claim 7 wherein a pull force of between 7–15 kg is required to rupture said vacuum bag upon pulling said pull handle from any of a plurality of angles with respect to said vacuum bag.

9. An assembly as defined in claim 1 including a second neck portion extending from said vacuum bag, a connector loop positioned within said neck portion, a weld within said neck portion forming a closed loop within said connector loop, an opening within said weld with said second neck portion and extending through said second neck portion, and second connecting means connecting said connector loop and said actuation means.

* * * * *